US006276172B1

(12) United States Patent
Rottman et al.

(10) Patent No.: US 6,276,172 B1
(45) Date of Patent: Aug. 21, 2001

(54) PROCESS FOR PRODUCING ULTRAPURE NITROGEN

(75) Inventors: Dietrich Rottman; Christian Kunz, both of München (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/437,263

(22) Filed: Nov. 10, 1999

(30) Foreign Application Priority Data

Nov. 11, 1998 (DE) ..... 198 52 019
May 27, 1999 (DE) ..... 199 24 375

(51) Int. Cl.[7] ..... F25J 3/00
(52) U.S. Cl. ..... 62/653; 62/920
(58) Field of Search ..... 62/643, 648, 653, 62/620, 920

(56) References Cited

U.S. PATENT DOCUMENTS

| | | | | |
|---|---|---|---|---|
| 4,464,188 | | 8/1984 | Rakesh . | |
| 5,123,947 | * | 6/1992 | Agrawal | 62/643 |
| 5,167,125 | | 12/1992 | Rakesh . | |
| 5,170,630 | * | 12/1992 | Stern | 62/643 |
| 5,351,492 | * | 10/1994 | Agrawal et al. | 62/648 |
| 5,421,164 | * | 6/1995 | Brugerolle | 62/648 |
| 5,638,699 | * | 6/1997 | Yamamoto et al. | 62/643 |
| 5,906,113 | * | 5/1999 | Lynch et al. | 62/646 |

FOREIGN PATENT DOCUMENTS

| | | |
|---|---|---|
| 198 06 576 A1 | 8/1998 | (DE) . |
| 0 569 310 | 11/1993 | (EP) . |
| 0 834 711 | 4/1998 | (EP) . |

* cited by examiner

*Primary Examiner*—William Doerrler
(74) *Attorney, Agent, or Firm*—Millen, White, Zelano & Branigan, P.C.

(57) ABSTRACT

For producing ultrapure nitrogen by low-temperature fractionation of air in a rectification system having at least one rectification column, compressed and purified feed air is conducted into a high pressure column, an oxygen-free pressurized nitrogen fraction is produced from the high pressure column, conducted into a low-pressure column and in the low-pressure column carbon-monoxide-free low-pressure nitrogen is produced as overhead gas. The oxygen-free pressurized nitrogen fraction (1) is either taken off in the liquid state from an upper region of the high pressure column or is provided from a liquid tank (22) containing stored oxygen-free nitrogen and the oxygen-free pressurized nitrogen fraction (1) is expanded into the bottom-heated low-pressure column (2). Ascending vapour in the lowpressure column (2) by mass transfer with and an ultrapure nitrogen reflux applied at the top of the low-pressure column (2) and is freed from carbon monoxide using ultrapure nitrogen, withdrawn as carbon-monoxide-free overhead gas (5) at the top of the low-pressure column (2). After a pressure increase the overhead (5), is partially liquefied, and the liquefied part (17, 18) is expanded into a bottom-heated He—Ne—$H_2$ column (4) from which the ultrapure nitrogen (19) is withdrawn in the liquid state.

20 Claims, 5 Drawing Sheets

PROCESS FOR PRODUCING ULTRAPURE NITROGEN

The invention relates to a process for producing ultrapure nitrogen by lowtemperature fractionation of air in a rectification system having at least one rectification column, in which process compressed and purified feed air is conducted into a pressure column (synonymously termed a "high pressure" column in the United States), an oxygen-free pressurized nitrogen fraction is produced from the pressure column, conducted into a low-pressure column and in the low-pressure column carbon-monoxide-free low-pressure nitrogen is produced as overhead gas.

BACKGROUND OF THE INVENTION

German Patent Application DE 198 06 576 A1 published Aug. 6, 1998 discloses a process wherein an oxygen-free pressurized nitrogen fraction is taken off from a pressure column. In order for the nitrogen to be also carbon-monoxide-free, the pressure column has at least 160 theoretical plates. However, the energy requirement for this, despite the 160 theoretical plates, is still very high. It is also a disadvantage that most of the ultrapure nitrogen is produced in the gaseous state.

SUMMARY OF THE INVENTION

It is therefore an object of one aspect of the invention to avoid this disadvantage and to decrease the energy requirement.

A further object of an aspect of the invention is to provide a process which is optionally operated with a liquid pressurized nitrogen fraction directly from the pressure column or from a tank containing liquid pressure-column nitrogen.

Upon further study of the specification and appended claims, other aspects of the invention will become apparent. In brief, the invention comprises a process for producing ultrapure nitrogen by low-temperature fractionation of air in a rectification system having at least one rectification column, in which process compressed and purified feed air is conducted into a pressure column, an oxygen-free pressurized nitrogen fraction is produced from the pressure column, conducted into a low-pressure column and in the low-pressure column carbon-monoxide-free low-pressure nitrogen is produced as overhead gas, characterized in that the oxygen-free pressurized nitrogen fraction is either taken off in the liquid state from the upper 50% of the pressure column or is provided from a liquid tank containing stored oxygen-free nitrogen and in that the oxygen-free pressurized nitrogen fraction is expanded into the bottom-heated low-pressure column, ascending vapour being formed in the low-pressure column and being freed from carbon monoxide using a reflux of ultrapure nitrogen applied at the top of the low-pressure column, being taken off at the top of the low-pressure column as carbon-monoxide-free overhead gas and after a pressure increase being partly liquefied and the liquefied part being expanded into a bottom-heated He—Ne—$H_2$ column from which the ultrapure nitrogen is taken off in the liquid state.

It is characteristic of the invention that the oxygen-free pressurized nitrogen fraction is either taken off in the liquid state from an upper region of the pressure column or is provided from a liquid tank containing stored oxygen-free nitrogen. (By "upper region" is meant the upper 50%, preferably the upper 15% of the pressure column.) The oxygen-free pressurized nitrogen fraction is expanded into the bottom-heated low-pressure column, ascending vapour being formed in the low-pressure column and being freed from carbon monoxide using a reflux of ultrapure nitrogen applied at the top of the low-pressure column. At the top of the low-pressure column, carbon-monoxide-free overhead gas is withdrawn, and after a pressure increase, is partly liquefied. The liquefied part is then expanded into a bottom-heated He—Ne—$H_2$ column from which the ultrapure nitrogen is taken off in the liquid state.

By means of the process according to the invention the ultrapure nitrogen is produced in the liquid state and can in this form be more readily transported and therefore more simply distributed to customers. The process, furthermore, is universally useable. This is because it can be used in connection with an air fractionation plant (with or without liquid nitrogen tank) or only with a liquid nitrogen tank (with spatial separation from the air fractionation plant). At an air fractionation plant having a liquid nitrogen tank, in addition, the ultrapure liquid nitrogen can also be produced without the air fractionation plant being in operation.

In an embodiment of the process of the invention, the carbon-monoxide-free overhead gas and an overhead gas of the He—Ne—$H_2$ column can be combined to form a carbon-monoxide-free cold gas stream.

Alternatively, the carbon-monoxide-free overhead gas can be partially liquefied in a condenser/evaporator against a liquid refrigerant which is simultaneously vaporized and a gas stream which is produced in the vaporization of the liquid refrigerant and an overhead gas of the He—Ne—$H_2$ column can be combined to form a carbon-monoxide-free cold gas stream.

Advantageously in both cases, the carbon-monoxide-free cold gas stream is warmed in a heat exchanger, compressed and cooled again in countercurrent in the same heat exchanger and one part is used in the low pressure column and another part is used in the He—Ne—$H_2$ column for heating the bottoms and is liquefied in the course of this, except for residual streams remaining in the gaseous state, and is fed as the liquid refrigerant to the condenser/evaporator.

The streams which are liquefied in the heating of the He—Ne—$H_2$ column and the low-pressure column can be fed as reflux to the He—Ne—$H_2$ column.

In the case of the use of a condenser/evaporator which is described above as an alternative, using the streams which are liquefied in the heating of the He—Ne—$H_2$ column and the low-pressure column, the carbon-monoxide-free overhead gas of the low-pressure column can be liquefied in the evaporator/condenser of the low-pressure column, except for a residual stream, and can be fed at least in part as reflux to the He—Ne—$H_2$ column. Counteracting the disadvantage of an additional capital cost of the condenser/evaporator is then the advantage, which is not to be underestimated, that in the case of air leaks during the compression of the carbon-monoxide-free gas stream, no contamination of the ultrapure liquid nitrogen can occur.

Ultrapure nitrogen can be withdrawn in the liquid state from the He—Ne—$H_2$ column and produced in part as the reflux for the low-pressure column and in part as liquid ultrapure nitrogen product.

The ultrapure liquid nitrogen product can be fed to a product tank.

The ultrapure liquid nitrogen product can also be pressurized using a pump, vaporized utilizing the cold content in the production of the oxygen-free pressurized nitrogen fraction, warmed and fed as gaseous pressurized product for use. In this case, gaseous ultrapure nitrogen product can also be produced by the process for producing ultrapure liquid nitrogen product and the cold of the originally present liquid product can be utilized efficiently.

In general, the ultrapure nitrogen has impurities below 1 mol ppm, preferably between 100 and $10^{-3}$ mol ppb for each of the components CO, $O_2$, Ar, $H_2$, Ne and He, with the most preferred being between 10 and $10^{-2}$ mol ppb. In practice the CO concentration is kept below such a maximum tolerated value resulting in $O_2$ and Ar concentrations far below this value.

The same occurs with $H_2$ and He if Ne is kept below such tolerated values. The use of the process according to the invention is not limited, in principle, to the above stated values.

BRIEF DESCRIPTION OF THE DRAWINGS

The invention is described in more detail with reference to schematic flowsheets of five non-limiting preferred embodiments.

Equivalent process streams and process steps are provided with identical reference numbers in FIGS. 1 to 5.

DETAILED DESCRIPTION OF THE DRAWINGS

Figure 1:
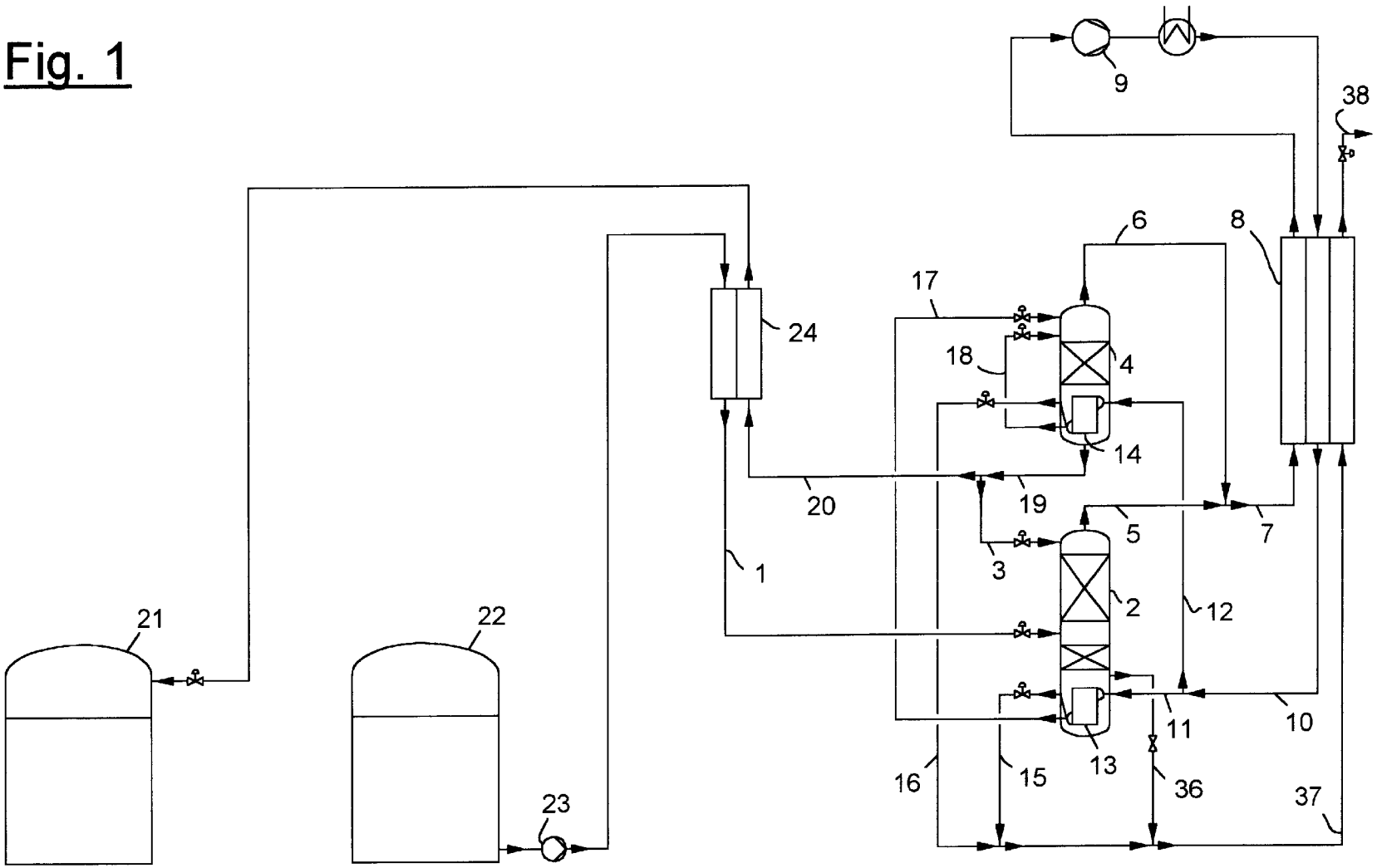
FIG. 1 shows a process according to the invention with provision of oxygen-free nitrogen for the process from a liquid nitrogen tank.

FIG. 1 diagrammatically shows an embodiment of the process of the invention for producing ultrapure nitrogen. A liquid pressurized nitrogen fraction 1, which is oxygen-free except for a residual content in the range of a few mol ppm is expanded into a heated low-pressure column 2 which is operated at a pressure between 4.5 and 5.5 bar. Vapour ascending in the low-pressure column 2 is freed, by ultrapure nitrogen 3 from an He—Ne—$H_2$ column 4 which is applied as reflux at the top, from carbon monoxide and thus from impurities boiling higher than carbon monoxide such as argon and the residual content of oxygen, depending on the purity requirement, except for a few mol ppb. The carbon monoxide-free overhead gas 5 and an overhead gas 6 of the He—Ne—$H_2$ column are combined to form a carbon-monoxide-free cold gas stream 7, warmed in a heat exchanger 8 and, after compression in compressor 9, cooled again in the same heat exchanger 8.

One part 11 of the cooled gas stream 10 is used in the low-pressure column 2 and another part 12 is used in the He—Ne—$H_2$ column 4 for heating the bottoms 13, 14 and are liquefied simultaneously, except for residual streams 15, 16 remaining in the gaseous state. The liquefied streams 17, 18 are fed as reflux to the He—Ne—$H_2$ column 4. From the He—Ne—$H_2$ column 4, carbon-monoxide-free ultrapure nitrogen 19 is withdrawn in the liquid state, which nitrogen 19 then also contains the lower-boiling neon and residual lower-boiling constituents hydrogen and helium, depending on specifications, on the order of magnitude of a few mol ppb. One part 3 of the liquid ultrapure nitrogen 19 is used as reflux to the low-pressure column 2 and another part is produced as liquid ultrapure liquid nitrogen product 20 and fed to a product tank 21. By way of further explanation, the contaminants He, Ne and $H_2$ leave column 4 with the overhead gaseous nitrogen 6. The stream 6 is conducted through the lines 7, 10 and 12, is used in the column 4 for heating the bottom and is thereby liquefied, except for a residual stream 16 remaining in the gaseous state and leaving the process through lines 16, 37 and 38 with the greater portion of the contaminants. The liquefied stream 18 with the smaller portion of the contaminants is fed as liquid reflux into the column 4, at the top; otherwise the column above the feedpoint would be dry. In column 4 the remaining contaminants of stream 17 reach the gaseous phase and ultrapure nitrogen 19 is withdrawn in the liquid state. The same as described for stream 18 also applies to stream 17 by analogy.

In the embodiment of the process according to the invention as in FIG. 1, the liquid pressurized nitrogen fraction 1 which is used as feed is taken off from a liquid tank 22 via a pressure boosting pump 23 and conducted via a heat exchanger 24 into the low-pressure column 2. In the heat exchanger 24, the ultrapure liquid nitrogen product 20 is subcooled and then expanded without gaseous expansion losses into the product tank 21. Because of the subcooling of the liquid nitrogen product 20, the product tank 21 can be designed as a liquid tank operated at atmospheric pressure.

Figure 2:
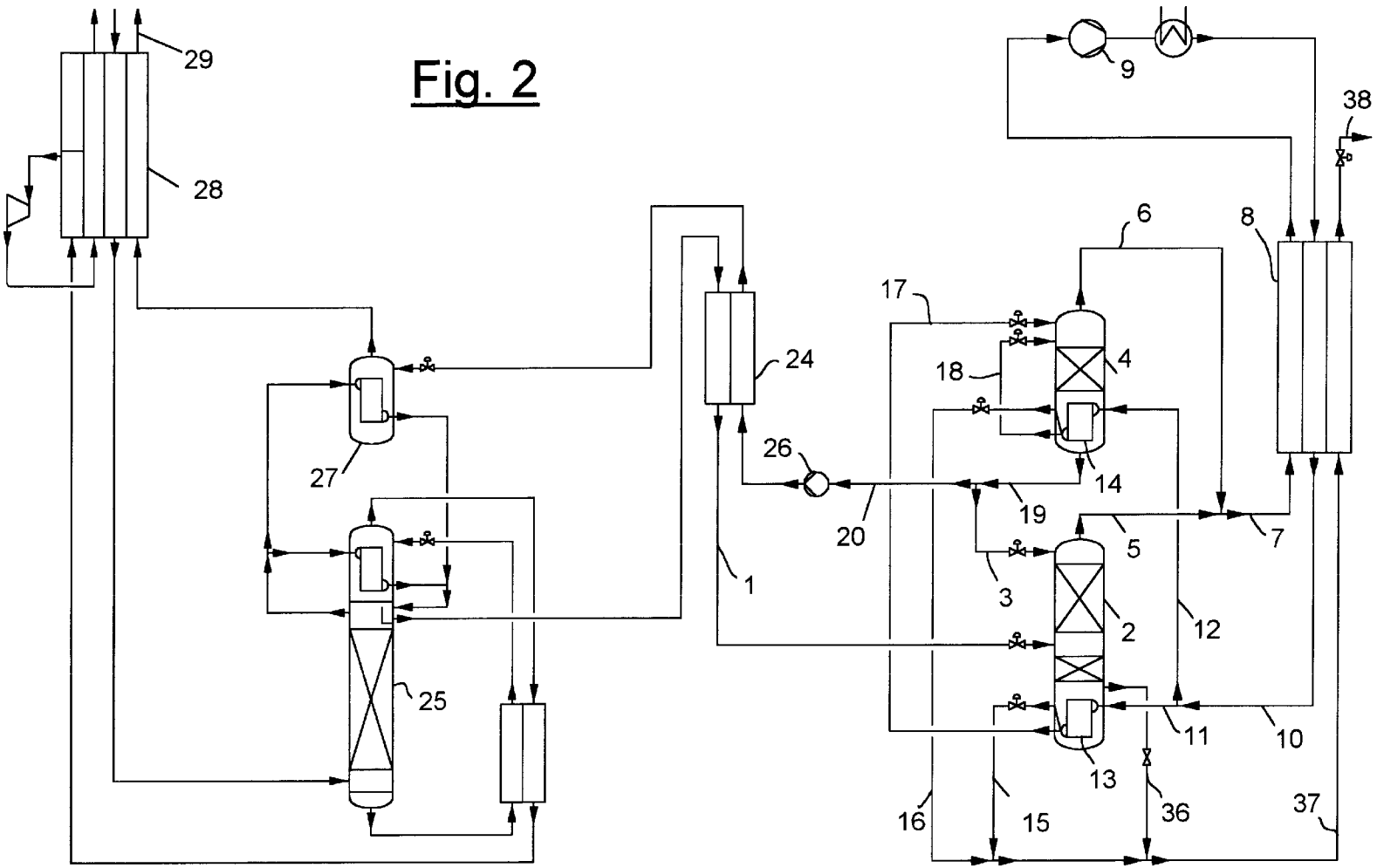
FIG. 2 shows a process according to the invention with provision of oxygen-free nitrogen for the process from the pressure column of a rectification system.

FIG. 2 shows diagrammatically the production of the ultrapure liquid nitrogen product 20 as in FIG. 1. The liquid nitrogen fraction 1 used as feed is, unlike the embodiment according to FIG. 1, taken off from a pressure column 25 of a rectification system and conducted via a heat exchanger 24 to the low-pressure column 2. The ultrapure liquid nitrogen product 20 is pressurized by a pump 26 passed in countercurrent to the liquid nitrogen fraction 1 through the heat exchanger 24 and used with utilization of the cold content in a condenser 27 and in a heat exchanger 28 in the production of the oxygen-free pressurized nitrogen fraction, thereby being evaporated, warmed and fed as gaseous ultrapure pressurized product 29 for further use.

Figure 3:
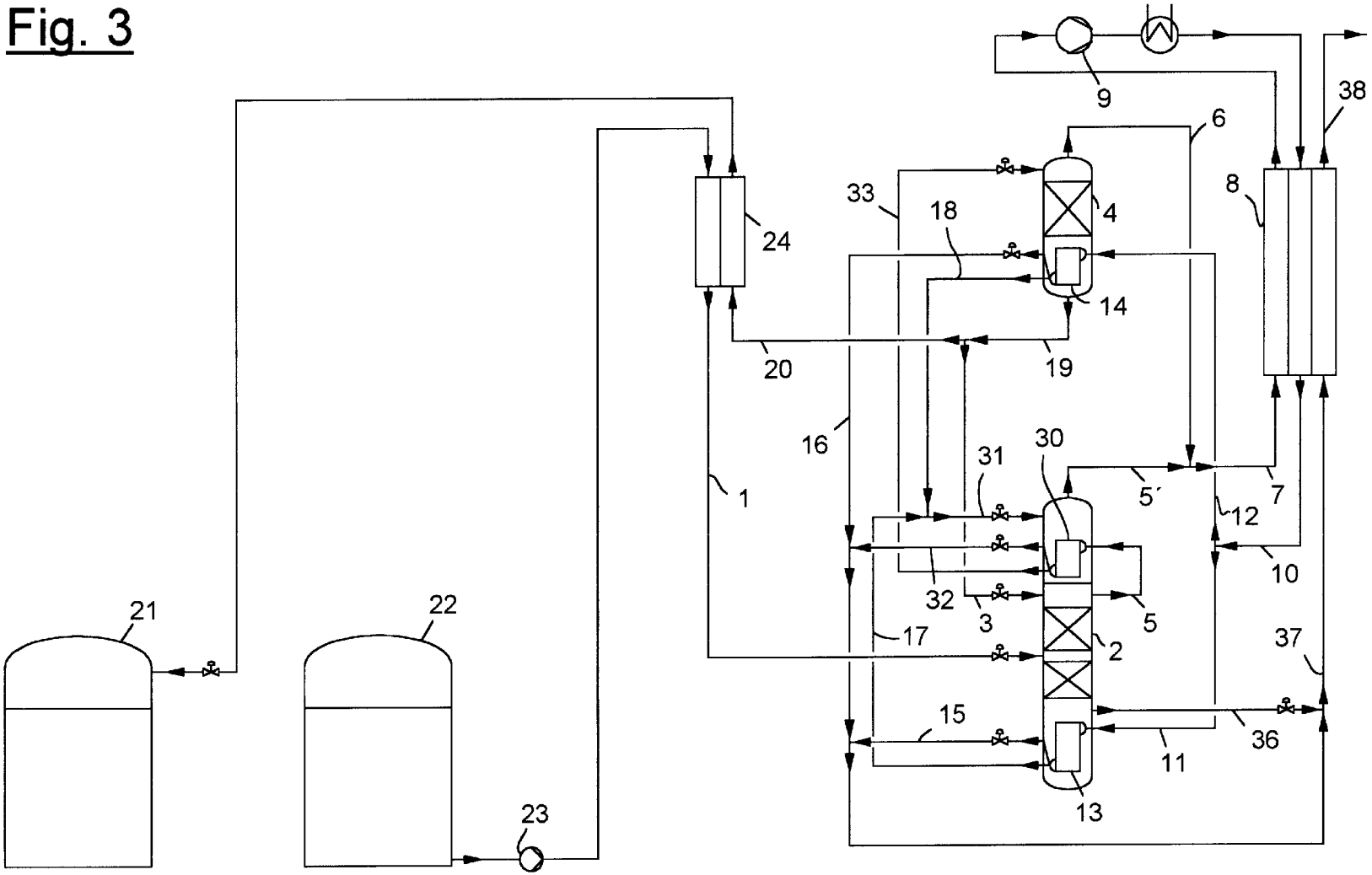
FIG. 3 shows a process as in FIG. 1, but having an additional evaporator/condenser.

FIG. 3 diagrammatically shows an embodiment of the process according to the invention with use of a condenser/evaporator 30. Unlike the embodiment according to FIG. 1, in the embodiment according to FIG. 3 the carbon-monoxide-free overhead gas 5 of the low-pressure column 2 is liquefied (against a liquid refrigerant 31 which is formed by combining the liquefied streams 17, 18 and thereby evaporates) in the condenser/evaporator 30, except for a residual stream 32 remaining in the gaseous state, and is used as reflux 33 in the He—Ne—$H_2$ column 4. A gas stream 5' formed in the vaporization of the liquid refrigerant and the overhead gas 6 of the He—Ne—$H_2$ column 4 are combined to form the cold carbon-monoxide-free gas stream 7.

Although additional capital costs are associated with the condenser/evaporator 30, the columns 2, 4 are decoupled so that even in the case of an air leak occurring during the compression into the carbon-monoxide-free gas 7, 10 the He—Ne—$H_2$ column 4 and thus the ultrapure nitrogen product 20 are not contaminated.

Figure 4:
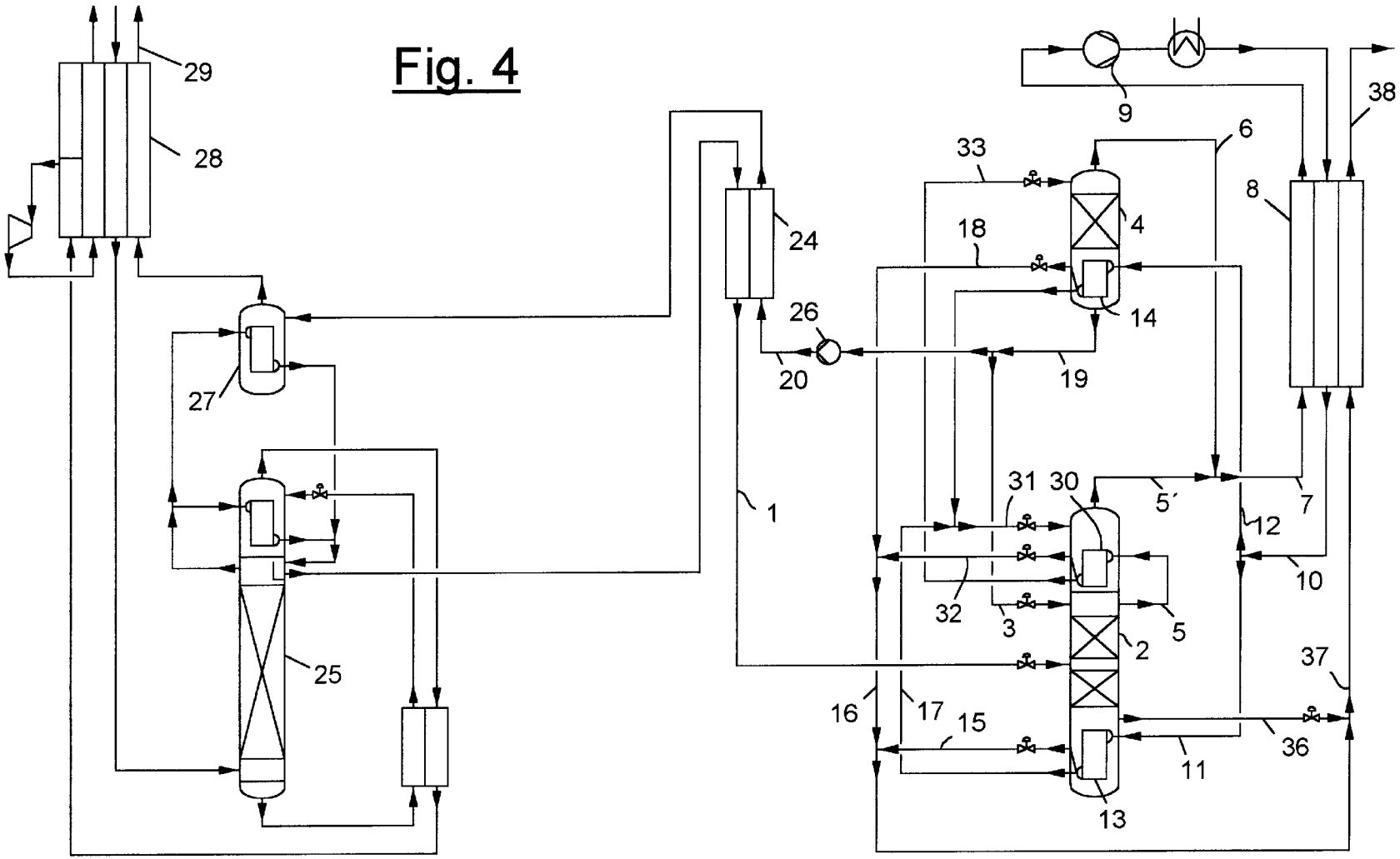
FIG. 4 shows a process as in FIG. 2 having an additional evaporator/condenser.

FIG. 4 diagrammatically shows an embodiment of the process according to the invention as in FIG. 2, but implemented with the condenser/evaporator 30 as in FIG. 3.

Figure 5:
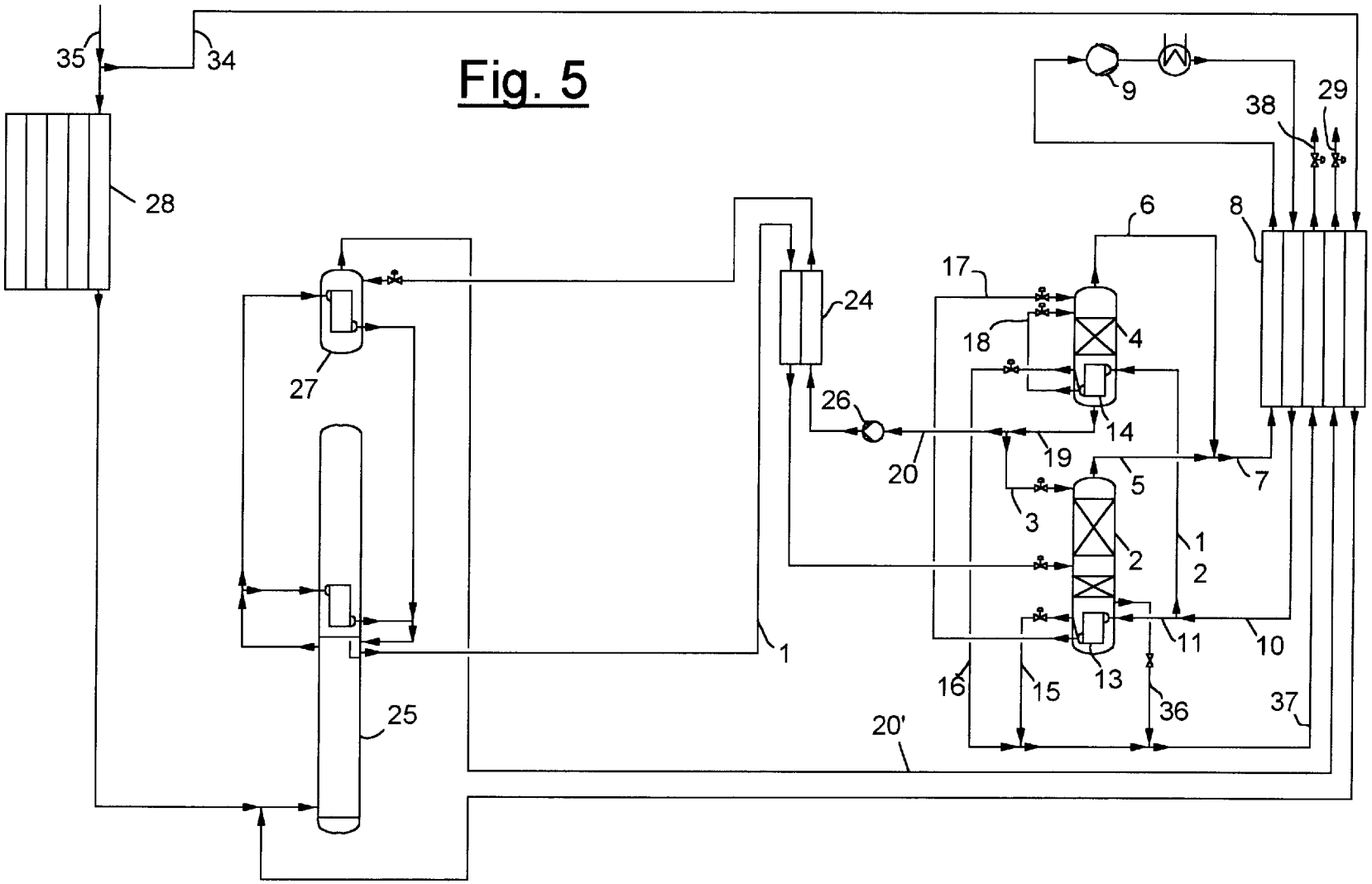
FIG. 5 shows a process as in FIG. 2 for the case of retrofitting a rectification system with the process according to the invention.

FIG. 5 diagrammatically shows that the process according to the invention can be used on an existing rectification system. Starting from the embodiment of the process as in FIG. 2, the condenser 27 is supplemented on the rectification system and the heat exchanger 8 receives two additional passages for the utilization of the cold of the ultrapure nitrogen 20', which is to be warmed, during the cooling and liquefaction of a partial stream 34 of the air 35 for the rectification system. The ultrapure nitrogen which is warmed in this case in the heat exchanger 8 is fed as gaseous ultrapure pressurized product 29 for further use.

A shared feature of the embodiment of the process according to the invention according to FIGS. 1 to 5 is that all residual gas streams arising (15, 16, 36 in FIGS. 1, 2 and 5; 15, 16, 32 and 36 in FIGS. 3 and 4) are combined to form a cold residual gas stream 37 in the heat exchanger 8, are warmed and are passed as impure gas 38 to the atmosphere.

EXAMPLE:

$m^3$ in this example denotes: $m^3$ under standard conditions at 0° C. and 1.0133 bar; i.e.

1 $m^3$ is equivalent to 1.25 kg.

Using the process according to the invention in the embodiment of FIG. 1, 1500 $m^3$/h of ultrapure liquid nitrogen containing 20 mol ppb of carbon monoxide are produced from 1750 $m^3$/h of liquid nitrogen containing 1 mol ppm of carbon monoxide. In this case, 100 $m^3$/h of losses are produced during compression and 150 $m^3$/h of residual gas are produced. 12,500 $m^3$/h of nitrogen are compressed from 6.5 to 7 bar; the pressure boosting pump operates between 1 bar at the inlet and 7 bar at the outlet.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German applications 198 52 019.0 and 199 24 375.1, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for producing ultrapure nitrogen by low-temperature fractionation of air in a rectification system having at least one rectification column, said process comprising providing an oxygen-free pressurized nitrogen fraction, characterized in that the oxygen-free pressurized nitrogen fraction is expanded into a bottom-heated low-pressure column, ascending vapour being formed in the low-pressure column and being freed from carbon monoxide using a reflux of ultrapure nitrogen applied at the top of the low-pressure column, the resultant ascending vapor being taken off at the top of the low-pressure column as carbon-monoxide-free overhead gas and after a pressure increase being partly liquefied and the liquefied part being expanded into a bottom-heated He—Ne—$H_2$ column from which the ultrapure nitrogen is taken off in the liquid state.

2. A process according to claim 1, characterized in that the carbon-monoxide-free overhead gas and an overhead gas of the He—Ne—$H_2$ column are combined to form a carbon-monoxide-free cold gas stream.

3. A process according to claim 1, characterized in that the carbon-monoxide-free overhead gas is partially liquefied in a condenser/evaporator against a liquid refrigerant which is vaporized in the course of this and in that a gas stream which is produced in the vaporization of the liquid refrigerant and an overhead gas of the He—Ne—$H_2$ column are combined to form a carbon-monoxide-free cold gas stream.

4. A process according to claim 3, characterized in that the carbon-monoxide-free cold gas stream is warmed in a heat exchanger, compressed and cooled again in countercurrent in the same heat exchanger and one part is then passed to the low-pressure column and another part is passed to the He—Ne—$H_2$ column for heating the bottoms and is liquefied therein, except for residual streams remaining in the gaseous state, and is fed as the liquid refrigerant to the condenser/evaporator.

5. A process according to claim 4, characterized in that the streams which are liquefied in the heating of the He—Ne—$H_2$ column and the low-pressure column are fed as reflux to the He—Ne—$H_2$ column.

6. A process according to claim 4, characterized in that using the streams which are liquefied in the heating of the He—Ne—$H_2$ column and the low-pressure column, the carbon-monoxide-free overhead gas of the low-pressure column is liquefied in the evaporator/condenser of the low-pressure column, except for a residual stream and is fed at least in part as reflux to the He—Ne—$H_2$ column.

7. A process according to claim 1, characterized in that ultrapure nitrogen withdrawn in the liquid state from the He—Ne—$H_2$ column is produced in part as reflux for the low-pressure column and in part as liquid ultrapure nitrogen product.

8. A process according to claim 7, characterized in that the ultrapure liquid nitrogen product is fed to a product tank.

9. A process according to claim 7, characterized in that the ultrapure liquid nitrogen product is pressurized using a pump, vaporized utilizing the cold content in the production of the oxygen-free pressurized nitrogen fraction, warmed and as gaseous pressurized product.

10. A process according to claim 1, wherein the provided oxygen-free pressurized nitrogen fraction is withdrawn from a liquid storage tank containing oxygen-free nitrogen.

11. A process according to claim 3, wherein the provided oxygen-free pressurized nitrogen fraction is withdrawn from a liquid storage tank containing oxygen-free nitrogen.

12. A process according to claim 4, wherein the provided oxygen-free pressurized nitrogen fraction is withdrawn from a liquid storage tank containing oxygen-free nitrogen.

13. A process according to claim 5, wherein the provided oxygen-free pressurized nitrogen fraction is withdrawn from a liquid storage tank containing oxygen-free nitrogen.

14. A process according to claim 6, wherein the provided oxygen-free pressurized nitrogen fraction is withdrawn from a liquid storage tank containing oxygen-free nitrogen.

15. A process according to claim 7 wherein the provided oxygen-free pressurized nitrogen fraction is withdrawn from a liquid storage tank containing oxygen-free nitrogen.

16. A process according to claim 1 wherein the provided oxygen-free pressurized nitrogen fraction is withdrawn from the upper 50% of a pressure column, the latter column being fed with compressed and purified air.

17. A process according to claim 3 wherein the provided oxygen-free pressurized nitrogen fraction is withdrawn from the upper 50% of a pressure column, the latter column being fed with compressed and purified air.

18. A process according to claim 4 wherein the provided oxygen-free pressurized nitrogen fraction is withdrawn from the upper 50% of a pressure column, the latter column being fed with compressed and purified air.

19. A process according to claim 5 wherein the provided oxygen-free pressurized nitrogen fraction is withdrawn from the upper 50% of a pressure column, the latter column being fed with compressed and purified air.

20. A process according to claim 7 wherein the provided oxygen-free pressurized nitrogen fraction is withdrawn from the upper 50% of a pressure column, the latter column being fed with compressed and purified air.

* * * * *